United States Patent [19]

Schmidt

[11] Patent Number: 4,944,450

[45] Date of Patent: Jul. 31, 1990

[54] OVERSIZE LASER MAILER AND METHOD

[75] Inventor: Eric Schmidt, Elgin, Ill.

[73] Assignee: Wallace Computer Services, Inc., Hillside, Ill.

[21] Appl. No.: 391,302

[22] Filed: Aug. 9, 1989

[51] Int. Cl.[5] ..... B65D 27/06; B65D 27/12

[52] U.S. Cl. ..... 229/73; 229/92.7

[58] Field of Search ..... 229/73, 92.1, 92.7

[56] References Cited

U.S. PATENT DOCUMENTS

| | | | |
|---|---|---|---|
| 882,297 | 3/1908 | Cook | 229/92.7 |
| 1,280,723 | 10/1918 | Harris | 229/92.1 |
| 2,152,135 | 3/1939 | Case et al. | 229/92.1 |
| 2,316,757 | 4/1943 | Berkowitz | 229/92.7 |
| 2,881,971 | 4/1959 | De Tolve | 229/92.1 |
| 3,525,469 | 8/1970 | Sandon | 229/92.7 |
| 3,606,138 | 9/1971 | Allison | 229/92.7 |
| 4,487,360 | 12/1984 | Fisher et al. | 229/92.7 |
| 4,630,768 | 12/1986 | Bradley | 229/92.7 |

*Primary Examiner*—Stephen P. Garbe

*Attorney, Agent, or Firm*—Tilton, Fallon, Lungmus & Chestnut

[57] ABSTRACT

Oversized laser mailer and method wherein a sheet such as 17″×11″ has static information on one face and variable information on the other face, the sheet being transversely folded to provide an overlapping edge, equipped with ribbons of adhesive adjacent the folded edges, longitudinally folded and equipped with transverse lines of perforation adjacent the edges to provide tear off strips whereby removal of the tear off strips results in two separate sheets.

3 Claims, 2 Drawing Sheets

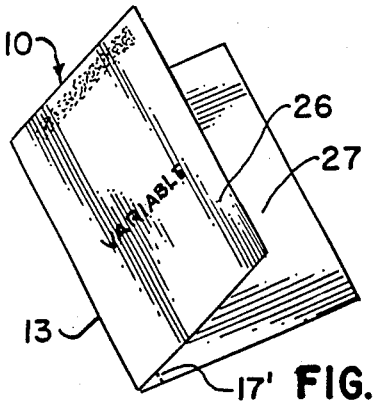
FIG. 3A
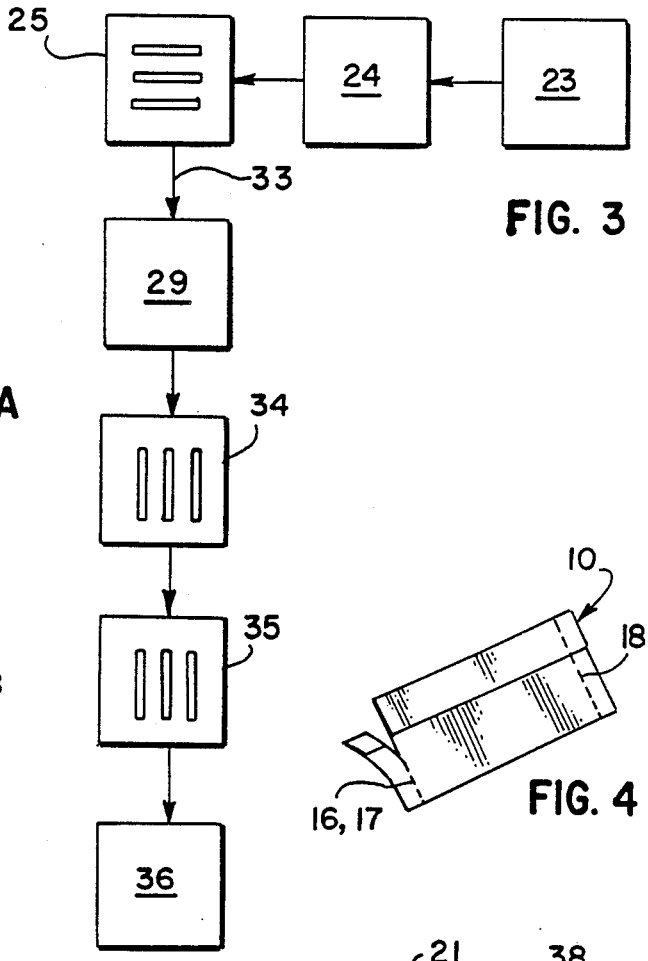
FIG. 3
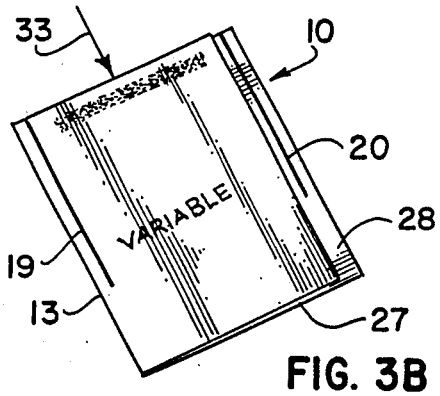
FIG. 3B
FIG. 4
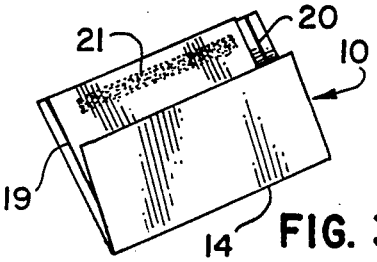
FIG. 3C
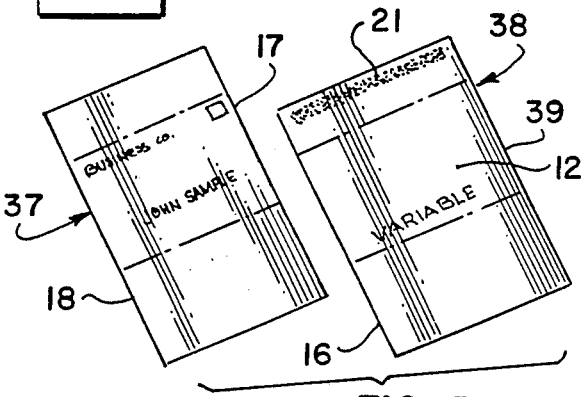
FIG. 5
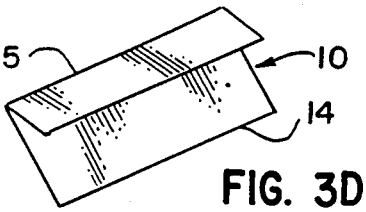
FIG. 3D
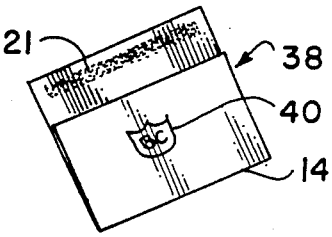
FIG. 6
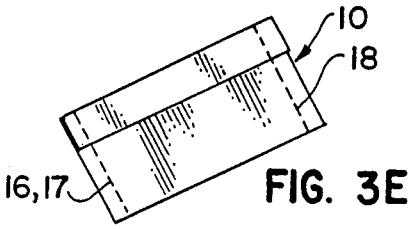
FIG. 3E
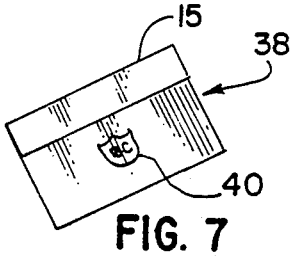
FIG. 7

OVERSIZE LASER MAILER AND METHOD

BACKGROUND AND SUMMARY OF INVENTION

This invention relates to an oversize laser mailer and method and, more particularly, to an improvement on co-owned U.S. Pat. No. 4,754,915.

There has been a need for providing more information on mailers than that which has been possible with the construction of U.S. Pat. No. 4,754,915. This is achieved through the instant invention by providing an oversize sheet (say 17" by 11") and subsequently folding, gluing and perforating the sheet into a mailing piece. Once opened, the mailing piece provides a two sheet mailer, each sheet being slightly under one-half the size of the original single sheet. By this construction, it is possible to increase the amount of information area in the mailing piece, both of the static and the variable type of information.

The invention is described in conjunction with the accompanying drawing, in which FIG. 1 is a plan view of the face of the oversize sheet which carries the static information, i.e., the information that does not change in going from one mailer to another;

FIG. 3 is a schematic view of apparatus employed in practicing the method of the invention;

FIGS. 3A–3E are perspective views of the oversize mailer in various stages of preparation and completion;

FIG. 4 is a perspective view of the mailer at the time of opening by the recipient;

FIG. 5 is a perspective view of the two sheets of the mailer after the same has been stripped of the tear off margins and unfolded;

FIG. 6 is a perspective view of one of the sheets in the process of being refolded so as to serve as a reply envelope; and FIG. 7 is a view of the reply envelope in its completed form ready for posting back to the original sender.

DETAILED DESCRIPTION

Figure 1:
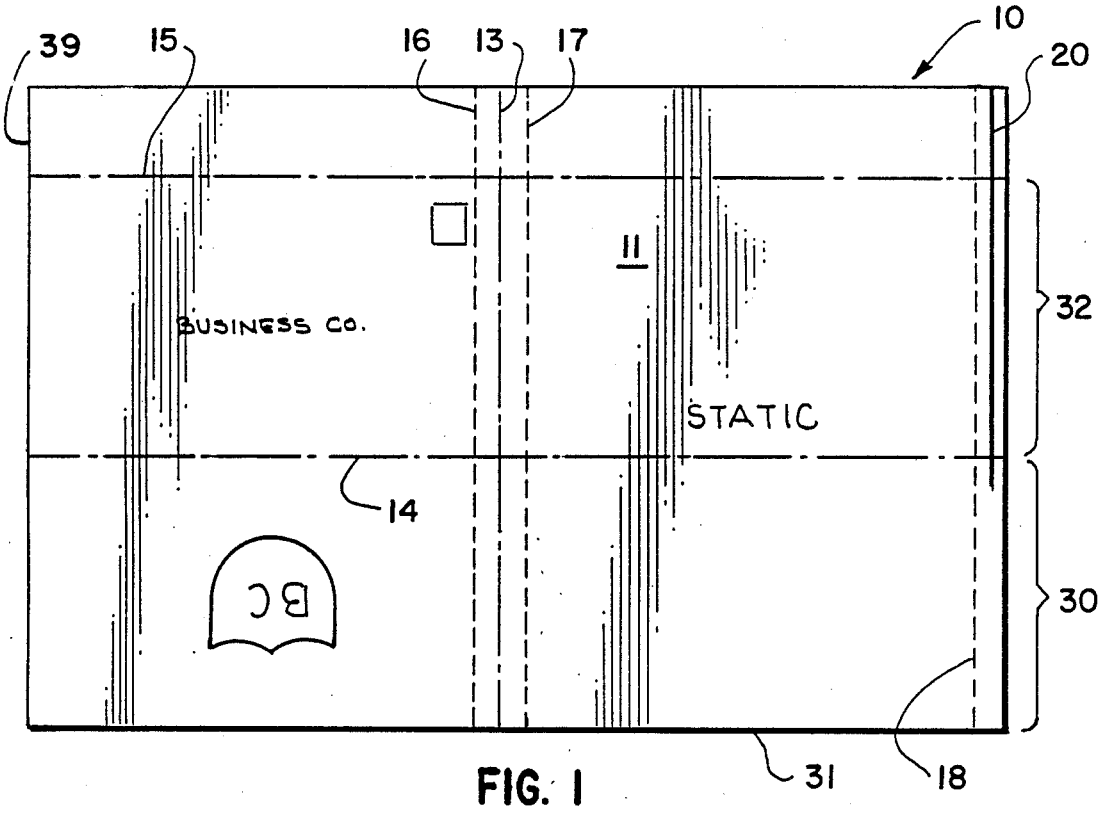

In the illustration given and with reference first to FIG. 1, the oversize mailer is generally designated 10. It is rectangular (17"→11") and is characterized by a first face 11 which carries the static information, i.e., that which does not change in going from one mailer to another.

Figure 2:
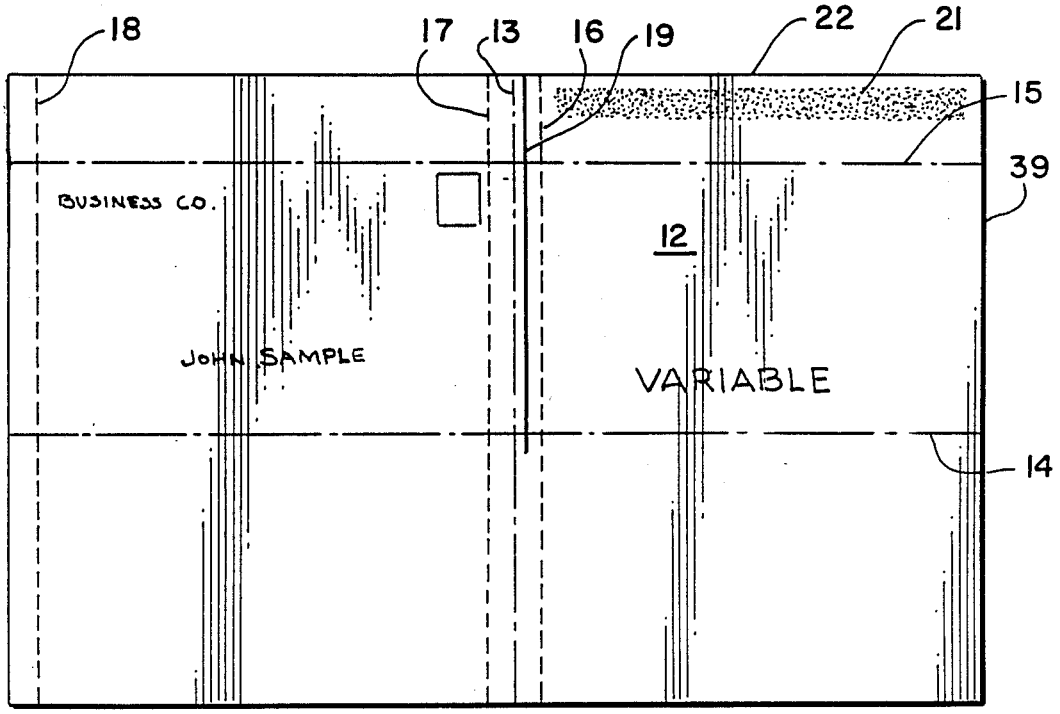
FIG. 2 is a plan view of the opposite face of the oversize mailer as would be seen by turning the construction of FIG. 1 180°, end-for-end.

The reverse face 12 is seen in FIG. 2 and this carries the variable information which does change in going from mailer to mailer. In both FIGS. 1 and 2 there is a transverse fold line 13 (slightly off center longitudinally) which is represented by a chain line, i.e., a dot-long dash line. Two other fold lines are illustrated as at 14 and 15 which are longitudinal folds as will be explained in greater detail hereinafter with respect to FIGS. 3C and 3D.

Also illustrated in the two views are three transversely extending lines of perforation which are illustrated with short dashes as at 16, 17 and 18. These are employed to provide tear off strips for opening the mailer—as depicted in FIG. 4.

Also seen in FIGS. 1 and 2 are glue lines which extend partly transversely of the mailer 10 and which are designated 19 in FIG. 2 for the adhesive applied to the variable face 12 and 20 in FIG. 1 for the adhesive applied to the static face 11.

One preferred embodiment of the invention makes use of the oversize mailer to provide a return envelope and, where this is desired, a band of remoistenable adhesive 21 (see the upper right hand portion of FIG. 2) may be employed. In such a case, the upper longitudinal fold line 15 is located fairly close to the edge 22 adjacent the adhesive band 21 so as to provide a flap for the return envelope. Where this is not desired, the longitudinal folds 14, 15 may be spaced differently, i.e., equally, so as to provide three identical size panels and the adhesive band 21 omitted.

It is believed that the invention will be better understood by a consideration of the method of making the same.

Method of Making

Now referring to the left hand portion of FIG. 3, the numeral 23 designates a stack of sheets cut to size for processing through a laser printer 24. The printer 24 prints the variable information generated by an associated computer. Prior to being cut, the sheets of stack 23 may be equipped with the band of remoistenable adhesive 21, as well as the static information. This is conveniently done on a conventional press (not shown). The printing operation is now completed and folding now occurs.

The transverse fold 13 is achieved through a buckle folder 25 of known construction—see my earlier application Ser. No. 244,727, filed Sept. 15, 1988. There, a pair of chute-providing plates operate in conjunction with pull rolls to fold the mailer blank or sheet 10 on itself. As indicated, particularly in FIG. 3B, the fold plies 26 and 27 are different lengths so as to provide a slight overlap portion 28.

The step of transversely folding is illustrated schematically in FIG. 3A and in its completed form in 3B. FIG. 3B also illustrates the application of two ribbons of adhesive which have been previously referred to at 19 and 20. These are applied through the use of an adhesive unit 29 which can be seen in the central portion of FIG. 3. The ribbons of adhesive 19, 20 do not extend completely across the width of the mailer 10 because there is no need to apply adhesive to the lowermost panel 30—see FIG. 1. This is the portion of the mailer between the longitudinal fold line 14 and its adjacent longer side 31. This panel 30 is adhered to the identical size panel 32 incident to longitudinal folding by virtue of the adhesive ribbons 19, 20 which have been applied to the panel 32.

More particularly, I change the direction of advance of the blanks 90°, as at 33 in FIGS. 3 and 3B. Thus, the adhesive ribbon or line 20 can be conveniently laid down by adhesive printing rolls on the static face while the same rolls apply the ribbon 19 to the variable face.

The step of longitudinally folding along the line 14 is illustrated in FIG. 3C and is achieved in the inventive method by means of another buckle folder 34. The final longitudinal fold—along the line 15—is illustrated in FIG. 3D and is achieved by another buckle folder 35. In actual practice, buckle folders are constructed to make up to four folds in the same apparatus—and the separate showings at 34 and 35 is merely for ease of understanding. It will also be appreciated that the terms "longitudinal" and "transverse" as used herein refer to the long and short dimensions of the sheet or blank 10—and not to the direction of advance or the dimensions of the folded sheet. For example, in FIG. 3B, the dimension parallel to the edge 31 is 8¾" and that parallel to the fold line 13 is 11". Nonetheless, the 8¾" dimension is longitudinal and the 11" dimension is transverse to agree with the nomenclature applied to the unfolded sheet 10.

Lastly, I prefer to transversely perforate the now folded, sealed envelope along the line 18 and the superposed lines 16, 17 by means of a perforation unit 36 positioned downstream of the final longitudinal fold 15. In some instances, it may be advantageous to perform the perforation earlier—as on the parent roll in the press, just as it is possible to do the static printing earlier in the process. However, as far as perforation is concerned, by perforating the completely folded product, I ensure that the lines are absolutely superposed so as to provide easy tear off.

The tear off strips are illustrated schematically in FIG. 4 where the folded mailer shown with the variable address information positioned outwardly. However, the variable information other than the address is positioned inwardly as can be seen from a consideration of FIGS. 3B and 3C.

This can be appreciated from the fact that the substantiative variable information is provided in the same portion of the mailer as that equipped with the remoistenable adhesive 21. This can be seen in the right hand portion of FIG. 2 where the portion of the mailer 10 to the right of the fold line 13 is designated "VARIABLE".

It should also be noted that the ribbon of adhesive 19 is positioned between the transverse fold line 13 and the transverse perforation line 16. The position of the line 16 in FIG. 3B is designated by the numeral 16' to indicate its ultimate location, bearing in mind that it has not yet been made. In similar fashion, just a portion of the position of the line 17 is illustrated in FIG. 3A by the numeral 17', to indicate that the lines 16 and 17 are ultimately superposed.

After the margins have been torn off—as indicated in FIG. 4—two trimmed sheets remain. One sheet 37 is that resulting from trimming along the perforation lines 18, 17 and the other sheet 38 results from trimming along the line 16 and the leading edge 39 of the mailer 10 (compare FIGS. 1 and 2). Should the recipient desire to return an envelope to the original sender, the resultant sheet 38 is again folded along the longitudinal lines 14 and 15 as illustrated in FIGS. 6 and 7, respectively. Again, the variable information is inside as can be appreciated from the fact that the logo 40 is now positioned exteriorly so that the exterior of the envelope contains only static information (compare FIG. 1). At this point, the band of remoistenable glue 21 is remoistened so as to develop the configuration seen in FIG. 7.

While in the foregoing specification a detailed description of an embodiment of the invention has been set down for the purpose of illustration, many variations in the details hereingiven may be made by those skilled in the art without departing from the spirit and scope of the invention.

I claim:

1. A folded single sheet mailer comprising a rectangular sheet having two long sides and two short sides, said sheet on one face being imprinted with variable information and static information on the other face, said sheet being folded on itself transverse to said long sides along a line offset from the middle of said sheet to provide one fold ply extending beyond the other fold ply and with the variable information containing face positioned outwardly, a transverse line of perforation in said one ply in the portion extending beyond the other fold ply, a transversely extending glue line on said static information face in said extending portion between said transverse line of perforation and the adjacent short side, superposed lines of transverse perforation in said one fold ply and said other fold ply adjacent said transverse fold line, a transversely extending glue line on said other ply on said variable information containing face between said superposed lines of perforation and said fold line, said sheet being folded on itself along two spaced apart longitudinally extending fold lines to provide a sealed envelope.

2. The structure of claim 1 in which the longitudinally extending fold lines are unequally spaced relative to the said long sides to provide a flap portion for a return envelope.

3. The structure of claim 2 in which said flap portion is equipped with a band of remoistenable adhesive.

* * * * *